US009359056B2

(12) United States Patent
Lyons et al.

(10) Patent No.: US 9,359,056 B2
(45) Date of Patent: Jun. 7, 2016

(54) LINEAR PROPULSION SYSTEM FOR SMALL WATERCRAFT

(71) Applicant: Michael Lyons, Standish, ME (US)

(72) Inventors: Michael Lyons, Standish, ME (US); Fred Finnemore, Damariscotta, ME (US)

(73) Assignee: Michael Lyons, Standish, ME (US)

( * ) Notice: Subject to any disclaimer, the term of this patent is extended or adjusted under 35 U.S.C. 154(b) by 0 days.

(21) Appl. No.: 14/704,543

(22) Filed: May 5, 2015

(65) Prior Publication Data

US 2015/0314848 A1 Nov. 5, 2015

Related U.S. Application Data

(60) Provisional application No. 61/996,270, filed on May 5, 2014.

(51) Int. Cl.

| | |
|---|---|
| ***B63B 35/71*** | (2006.01) |
| ***B63H 16/08*** | (2006.01) |
| ***B63H 23/02*** | (2006.01) |
| ***B63H 5/04*** | (2006.01) |
| *B63H 16/20* | (2006.01) |

(52) U.S. Cl.

CPC ..... *B63H 16/14* (2013.01); *B63B 35/71* (2013.01); *B63H 5/04* (2013.01); *B63H 23/02* (2013.01); *B63H 2016/202* (2013.01); *B63H 2023/025* (2013.01)

(58) Field of Classification Search

CPC ..... B63B 35/71; B63H 16/08; B63H 23/02; B63H 5/04

USPC ..... 440/14–26, 30

See application file for complete search history.

(56) References Cited

U.S. PATENT DOCUMENTS

| | | | | | |
|---|---|---|---|---|---|
| 2,180,890 | A * | 11/1939 | Weatherwax | B63H 1/36 | 416/108 |
| 3,440,994 | A * | 4/1969 | McGowan | A63B 35/02 | 440/15 |
| 4,642,056 | A * | 2/1987 | Keivanjah | B63H 1/36 | 416/66 |
| 4,968,273 | A * | 11/1990 | Momot | B63H 1/36 | 440/14 |
| 6,524,145 | B1 * | 2/2003 | Arzate | A63B 35/02 | 114/315 |
| 6,558,210 | B2 * | 5/2003 | Frasier | B63C 11/46 | 440/14 |
| 6,595,813 | B1 * | 7/2003 | Lekhtman | B63H 1/32 | 440/21 |
| 6,692,317 | B2 * | 2/2004 | Poissonniere | B63H 16/12 | 440/15 |
| 6,843,691 | B1 * | 1/2005 | Jelten | B63H 16/12 | 440/15 |
| 6,869,323 | B2 * | 3/2005 | Norman | B63B 7/04 | 440/21 |
| 8,167,667 | B2 * | 5/2012 | Sturm | B63B 7/085 | 440/21 |
| 8,992,272 | B1 * | 3/2015 | Malakiman | B63H 16/18 | 440/21 |
| 9,199,126 | B1 * | 12/2015 | Martin | A63B 31/08 | |
| 2004/0087225 | A1 * | 5/2004 | Norman | B63B 7/04 | 440/28 |
| 2015/0314848 | A1 * | 11/2015 | Lyons | B63H 16/14 | 440/30 |

* cited by examiner

*Primary Examiner* — Lars A Olson
*Assistant Examiner* — Jovon Hayes
(74) *Attorney, Agent, or Firm* — Jeffrey Joyce; Patricia Mathers

(57) ABSTRACT

A foot-operated propulsion system for small watercraft, such as kayaks. The propulsion system includes a pedal assembly that controls motion of a fluke fin that is submerged beneath the waters surface. The pedal assembly is located in the bow of the watercraft and the paddler works the pedals with his feet. Operating the pedal assembly causes a force to be transmitted to a drive unit located in the stern of the craft, which then controls movement of linkages in the fluke assembly, to force the submerged fluke fin to swing upward and downward, emulating the motion of flukes on a whale, and thereby propelling the watercraft along the surface of the water.

9 Claims, 15 Drawing Sheets

LINEAR PROPULSION SYSTEM FOR SMALL WATERCRAFT

BACKGROUND INFORMATION

1. Field of the Invention

The invention relates to propulsion systems for small watercraft, more particularly, the invention relates to a foot-operated propulsion system for a kayak.

2. Discussion of the Prior Art

Kayaks and other small watercrafts have existed for a long time and are traditionally operated by having a user, i.e., a paddler, use one or more oars or paddles to propel the craft through the water. Kayaking in particular is a popular paddle sport, whereby the paddler operates a relatively long, narrow vessel with a double-sided paddle. The paddler generally sits near the center of the craft such that the paddler's legs stretch out straight towards the bow, with feet at or near the same level as the paddler's hips. Traditionally, the paddler uses his/her upper body and arms to manipulate an oar or paddle to propel the watercraft through the water.

The largest and strongest muscles in a person, however, are typically the leg muscles. It would be advantageous, if the paddler could take advantage of the greater power those muscles can provide. Also, many people have disabilities or handicaps that make it difficult or impossible to operate an oar or paddle. Because of this, it is difficult or impossible for them to participate in activities that include kayaking or canoeing.

What is needed, therefore, is a propulsion system for small watercraft that is powered by a paddler's feet. What is further needed is such a system that is easy to use and does not impede beaching, launching, or transporting the watercraft.

BRIEF SUMMARY OF THE INVENTION

The invention is a foot-operated linear propulsion system for small watercraft that is particularly well suited for use with a kayak. The propulsion system comprises three main assemblies: 1) a pedal assembly; 2) a drive unit; and 3) a fluke assembly that includes a fluke activation mechanism and a fluke fin, often simply referred to as a fluke. The pedal assembly is positioned in the front of the craft, in the bow section, and is easily operated by paddler's feet. The drive assembly is located in the rear of the craft, i.e., in the stern, and, as the paddler works the pedals, a cable running beneath the paddler transmits a force to the drive unit. The drive unit controls the fluke fin activation mechanism, which causes a submerged fluke fin located outside the craft and extending beyond the stern to move up and down below the surface of the water, thereby propelling the craft along the surface of the water. The movement of the fluke fin mimics that of living water creatures, such as whales and dolphins. A lift mechanism is also provided to selectively raise the fluke assembly before launching, beaching, or transporting the kayak or watercraft.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
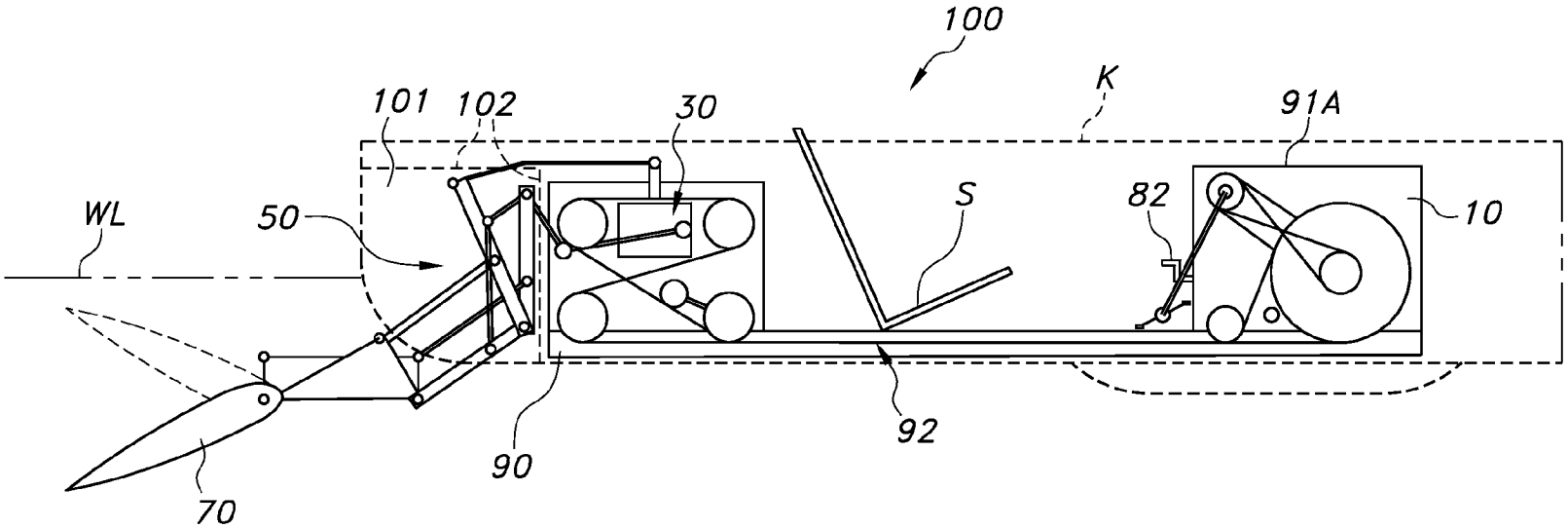
FIG. 1 is a side plan view of the system according to the invention.

FIG. 1 gives an overview of the major assemblies for a linear propulsion system 100 according to the invention, with intended use with small watercraft. The assemblies comprise a pedal assembly 10, a drive unit 30, and a fluke assembly 50 that includes a fluke 70 and a fluke lift mechanism 80. The pedal assembly 10 is positioned in the bow of the watercraft. The description hereinafter refers to the watercraft in terms of a Kayak K, however, it is understood that the inventive system may be used with other appropriate watercraft. A paddler (not shown) sits in an adjustable seat S that is slidably mounted in the kayak K, such that it is able to slide a distance toward the bow or the stern and, in this manner, able to accommodate the leg length of the particular paddler and thereby allow the paddler to comfortably operate the pedal assembly 10 with his or her feet. Working the pedal assembly 10 causes the drive unit 30 to actuate the fluke assembly 50, which causes the fluke 70 to move up and down below the surface of the water, thereby propelling the kayak K along the surface of the water.

Figure 2A:
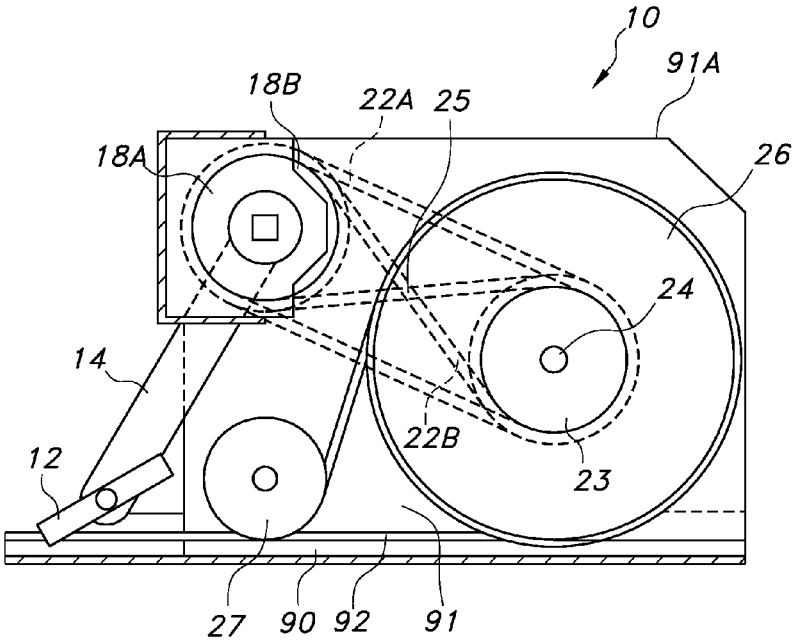
FIG. 2A is a side plan view of the first two embodiments of the pedal assembly.
Figure 2B:
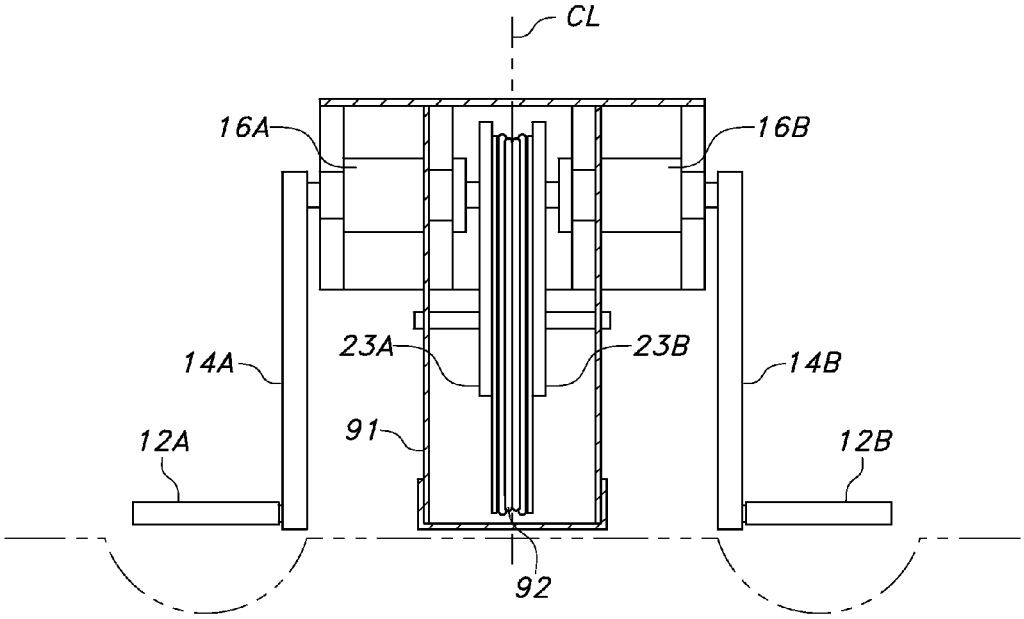
FIG. 2B is a front plan view of a portion of the pedal assembly.
Figure 2C:
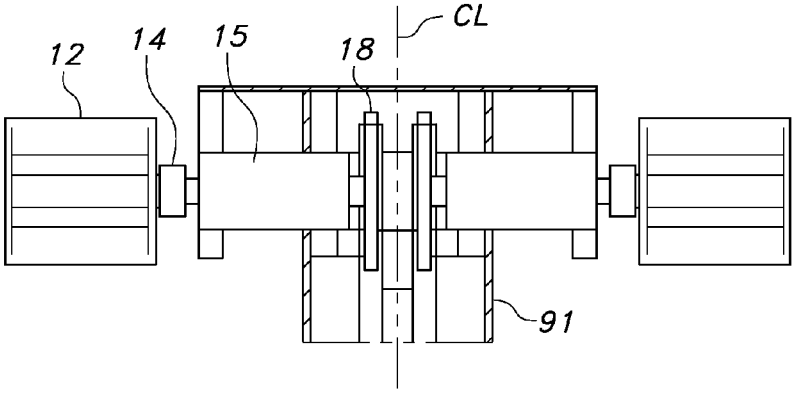
FIG. 2C is a top plan view of a portion of the pedal assembly.

FIGS. 2A, 2B, and 2C illustrate the pedal assembly 10, which is enclosed in a box formed by a cable tray 90 and vertical walls 91 and a top wall 91A. The cable tray 90 extends along the bottom portion of the kayak K, from beneath the pedal assembly 10 in the bow section of the kayak, back to the stern section beneath the drive unit 30 and is securely and immovably attached to the body of the kayak K. The cable tray 90 serves to guide and protect the cables of the various assemblies and the vertical walls 91 provide the support for the shafts and pulleys of the various assemblies. The walls 91 may extend the entire length of the tray or, as shown in the various figures, may be short walls that extend only partially along the length, so as to accommodate the assemblies, and may also be affixed to the body of the kayak K, as deemed necessary. In these figures, the vertical walls 91 and the top wall 91A, together with the cable tray 90, enclose the pulleys and cables, belts, or chains of the pedal unit 10. The pedal assembly 10 includes a pair of pedal units, each unit including a pedal 12, a pedal crank arm 14, and a pedal force transmission means 18. Each pedal 12 is affixed to its corresponding crank arm 14, which is coupled to a pedal force transmission means 18 that is mounted on a shaft that also supports the pedal force transmission means 18. Depending on the particular embodiment of the force transmission means 18, the crank arm 14 may be connected to a bearing assembly 16, which is mounted on the same shaft with the pedal force transmission means. Where necessary to illustrate the mechanics of the pedal assembly 10, the various elements are identified as 12A and 12B, 14A and 14B, 16A and 16B, and 18A and 18B, all elements with an "A", for example, belonging to the units on the left side of the kayak and all with a "B" belonging to the other unit on the right side.

The kayak K has a centerline CL that extends in the longitudinal direction of the kayak k. Each bearing assembly 16 is positioned at the inner end of a horizontal shaft 15 in the bow of the kayak K, the two horizontal shafts 15 creating an axis that extends transverse to the centerline CL. The crank arm 14 and pedals 12 are mounted on the outside ends of the respective shaft 15. A drum pulley 26 is mounted on a horizontal shaft 24 that extends transverse to the centerline CL and is positioned behind and parallel to the axis created by the horizontal shafts 15, the drum pulley 26 being centered about the centerline CL. The force from the pedal 12 may be mechanically transmitted in various ways to the drive unit 30.

In a first embodiment, for example, the pedal force transmission means 18 is a chain and sprocket assembly 18' that is used to exert a pull on the drum pulley 26, so that the pulley oscillates back and forth a distance of approximately plus/minus 45 degrees. In this case, pedal sprockets 18A and 18B are mounted on the horizontal shaft 15, one on each inner end of the respective horizontal shaft 15 and pulley sprockets 23 mounted to the horizontal shaft 24, one on either side of the drum pulley 26. A two-chain set 22 is used to convert the action of the two pedals 12 to an oscillating pull on the drum pulley 26.

The chain set 22 includes a first chain loop 22A and a second chain loop 22B. The first chain loop 22A runs continuously from the top of the pedal sprocket 18A around the top of the pulley sprocket 23A and then from the bottom of the pulley sprocket 23A to the bottom of the pedal sprocket 18A. The second chain loop 22B loops in a crossed manner from the top of the pedal sprocket 18B to the bottom of the pulley sprocket 23B and then around the top of the pulley sprocket 23B to the bottom of pedal sprocket 18B.

Figure 2D:
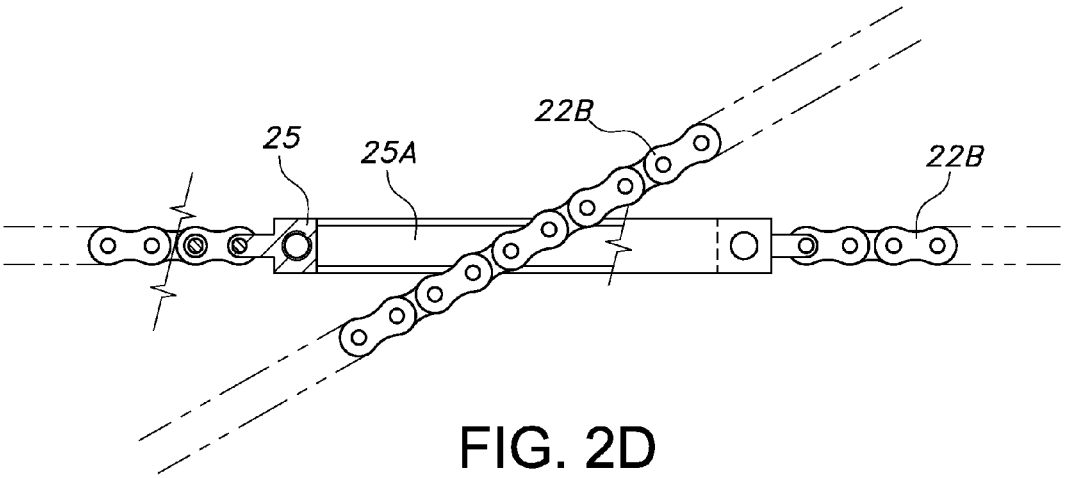
FIG. 2D is a top plan view of the modified chain link.
Figure 2E:
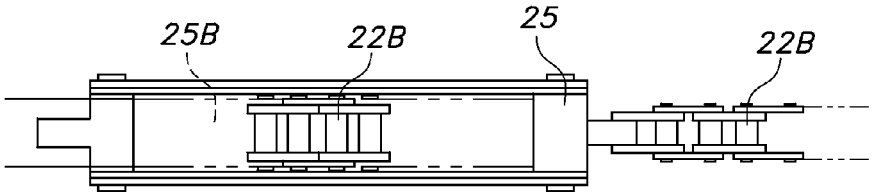
FIG. 2E is a side plan view of the modified chain link.

FIG. 2A shows that the path of the chain 22B is crossed, i.e., one section of the chain passes through another section of the same chain. A portion of the pedal sprocket 18B is cut out to show that the pedal sprocket 18A is behind the other sprocket. FIGS. 2D and 2E illustrate a modified link 25 in the second chain loop 22B that has a pass-through 25A that is dimensioned to accommodate the length of travel of the chain 22B as it oscillates back and forth by the pedal action. Crossing the second chain loop 22B in this manner allows the chain 22B to operate in a single vertical plane and serves to reverse the direction of pull on the corresponding pulley sprocket 23B. So, for example, pushing the right pedal 14A causes the drum 26 to rotate in the counterclockwise direction and pulls the left pedal 14B into position for the next push, and pushing the left pedal 14B causes the drum 26 to rotate in the clockwise direction and pulls the right pedal 14A into position for the next push. A drive cable 92 is wrapped around the drum pulley 26, which is dimensioned such that the angle of rotation mentioned above results in a pull length, i.e., stroke, of about six inches on the drive cable 92.

A second embodiment of the pedal force transmission means 18 is a belt or cable and pulley system 18". The configuration of this system is similar to that of the sprocket and chain system described above, except that the sprockets are replaced by pulleys and the set of two chains by a set of two belts or cables.

Figure 2F:
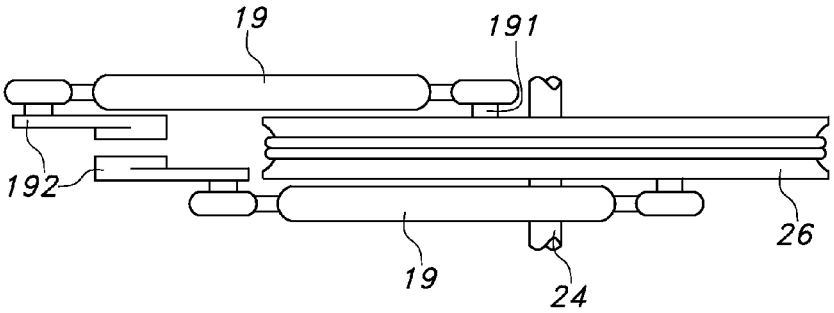
FIG. 2F is a top plan view of the third embodiment of the pedal assembly.
Figure 2G:
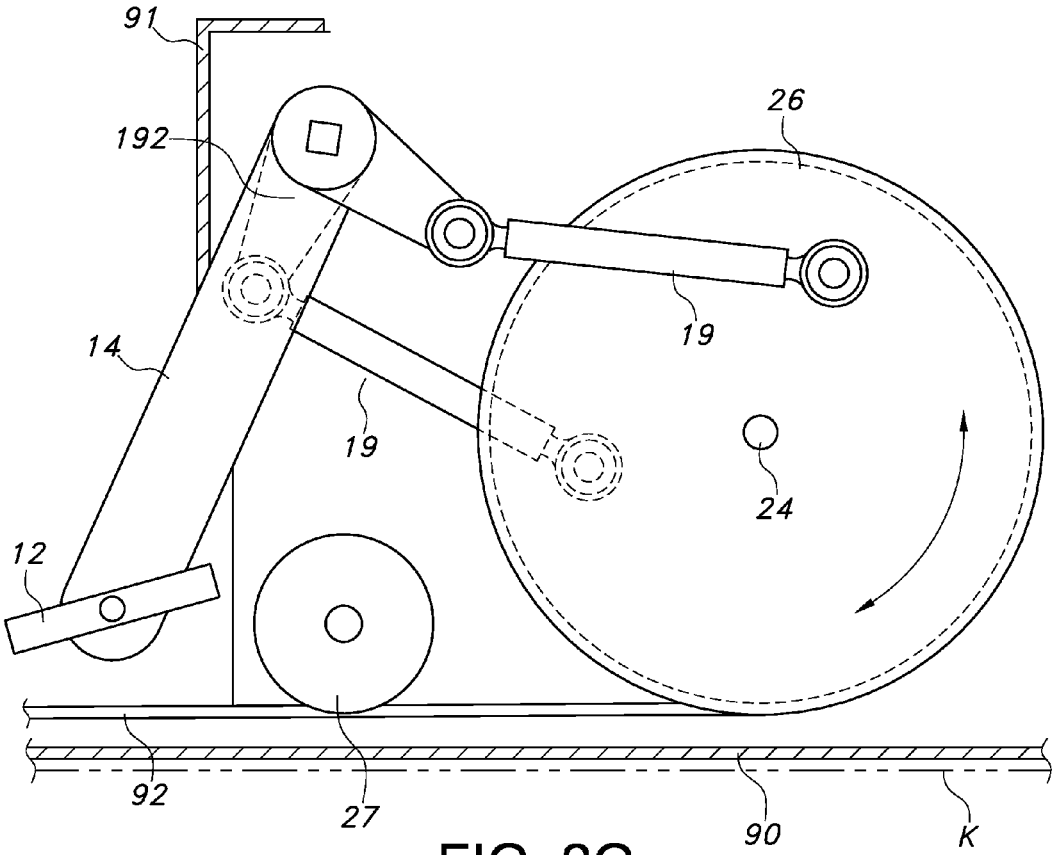
FIG. 2G is side plan view of the third embodiment of the pedal assembly.

FIGS. 2F and 2G illustrate a third embodiment of the pedal force transmission means 18''', which is a system of levers. A ball-end link 19 with a threaded stud 191 at both ends is used to couple a pedal lever 192 from each pedal 12 directly to the drum pulley 26. The two links 19 are mounted on the respective pedal levers 192 and on opposite sides of the drum pulley 26. As shown in FIG. 2G, the links 19 are coupled at different locations on the pedal levers 192 and the pulley 26, such that a forward push on one pedal 12 forces the pulley 26 to rotate in one direction and a forward push on the other pedal 12 forces rotation in the opposite direction. The ball-end link 19 is a well-known conventional component, such as, for example, a ball joint linkage available from McMaster-Carr.

Figure 3A:
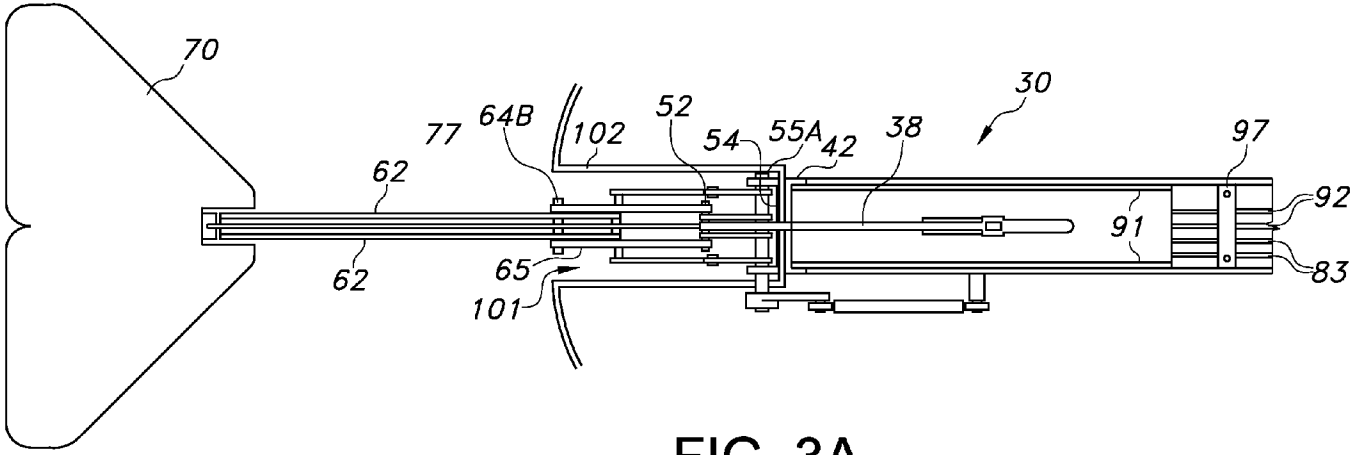
FIG. 3A is a top plan view of the fluke actuation and output drive assembly.
Figure 3B:
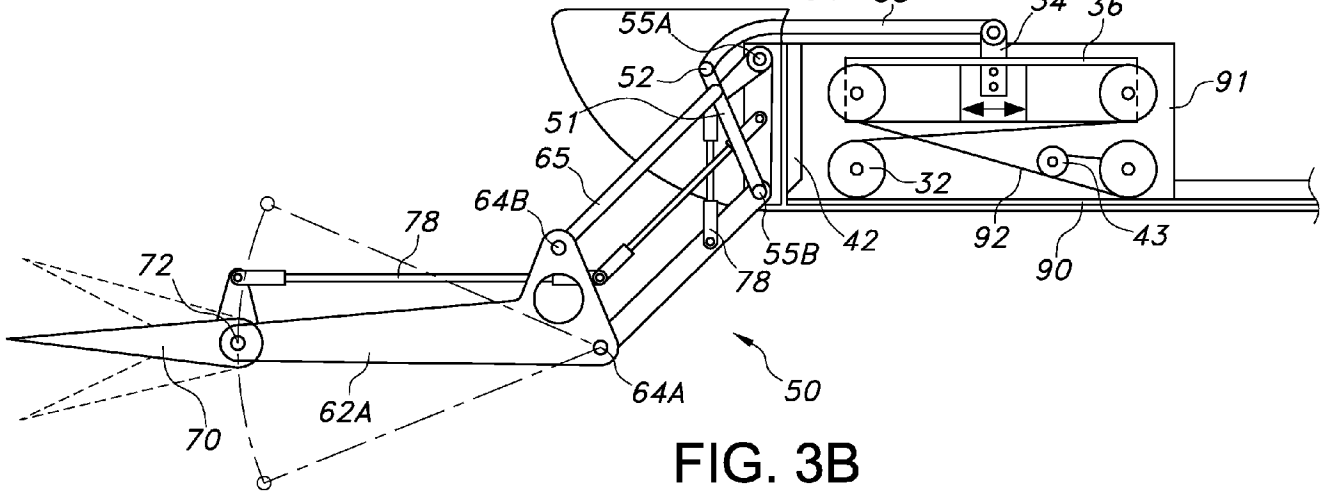
FIG. 3B is a side plan view of the fluke actuation and output drive assembly.

FIGS. 3A and 3B show that the drive unit 30 and a portion of the fluke assembly 50 are assembled in the stern section of the kayak K. To this end, an opening 101 is made in the stern section of the hull of the kayak, the upper end of the opening being above the waterline WL and extending down to the bottom of the hull, and being just wide enough to accommodate linkage for the fluke assembly 50. The opening is shown in FIG. 1, with a dashed or a dotted line across the top and down in front of the drive unit 30 and in FIG. 3D, which is a perspective view of the stern portion of the bottom hull of the kayak and shows the walls 102 forming a box. The walls 102 of the opening are affixed to the body of the kayak K and form a water-tight barrier between the opening 101 and the inside area of the kayak. Depending on the particular watercraft, the dimensions of the opening may vary. The inventor chose to install this propulsion system 100 in a Twin Heron model of a kayak made by the Old Town Canoe Company, because the shape of its stern is somewhat higher and more rounded than is the case with other types of kayaks. In this particular kayak, the opening 101 is about five inches wide and extends inward approximately 12 inches.

Figure 3C:
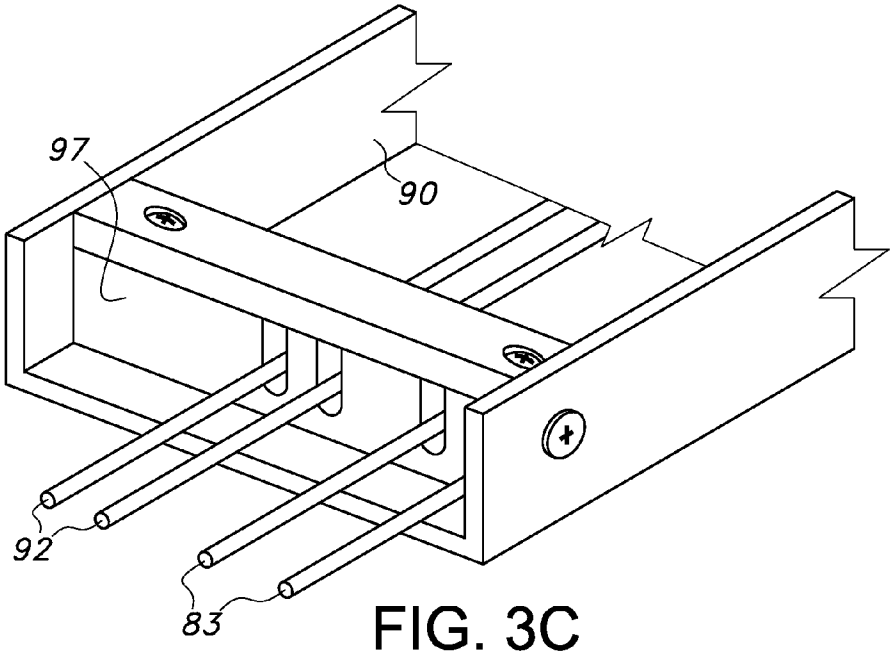
FIG. 3C is a partial perspective view of the cable tray.
Figure 3D:
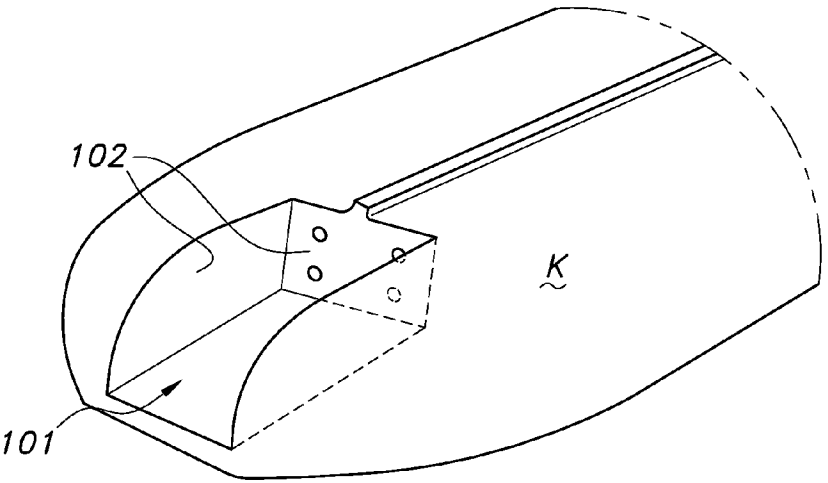
FIG. 3D is a partial perspective view of the stern section of the hull of the kayak, showing the cutout in the hull.

FIG. 3C is a perspective partial view of the cable tray 90, showing a cable guide 97 that serves to maintain the drive cable 92 and the lift cable 83 in proper alignment as they travel from the pedal unit 10 in the bow to the drive unit 30 and to the fluke lift mechanism 80 in the stern of the kayak K. FIGS. 3A and 3B illustrate the drive unit 30 and the fluke assembly 50. A drive cable 92 is wrapped around the drum pulley 26, passes through an idler pulley 27 and serves to couple the pedal unit 10 to the drive unit 30, where the drive cable 92 is then routed through a series of drive unit pulleys 32 which are mounted on shafts 99 that extend transverse to the centerline CL between two vertical walls 91 and which serve to align the cable 92.

Figure 4A:
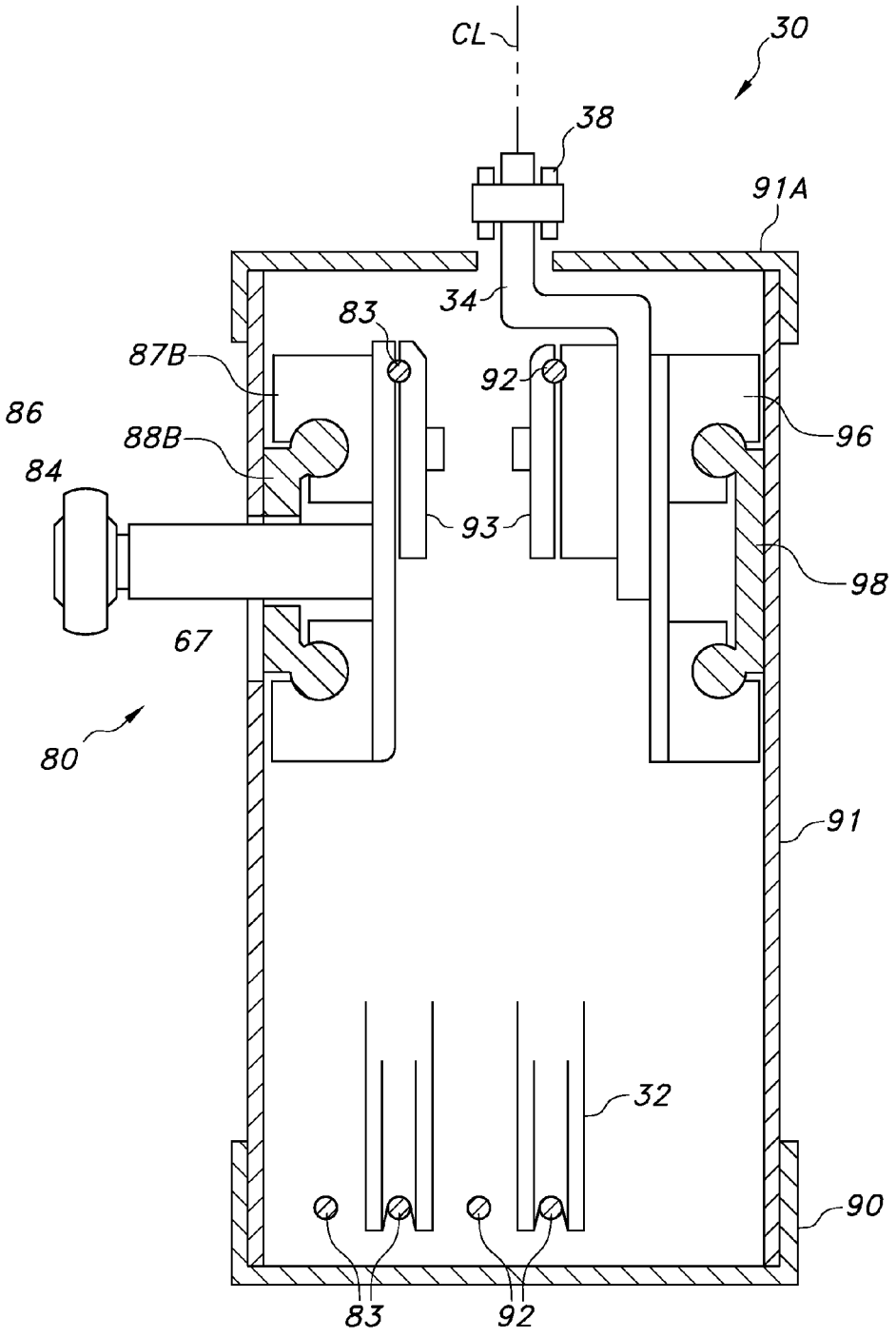
FIG. 4A is a cross-section of the drive unit in the cable tray.
Figure 4B:
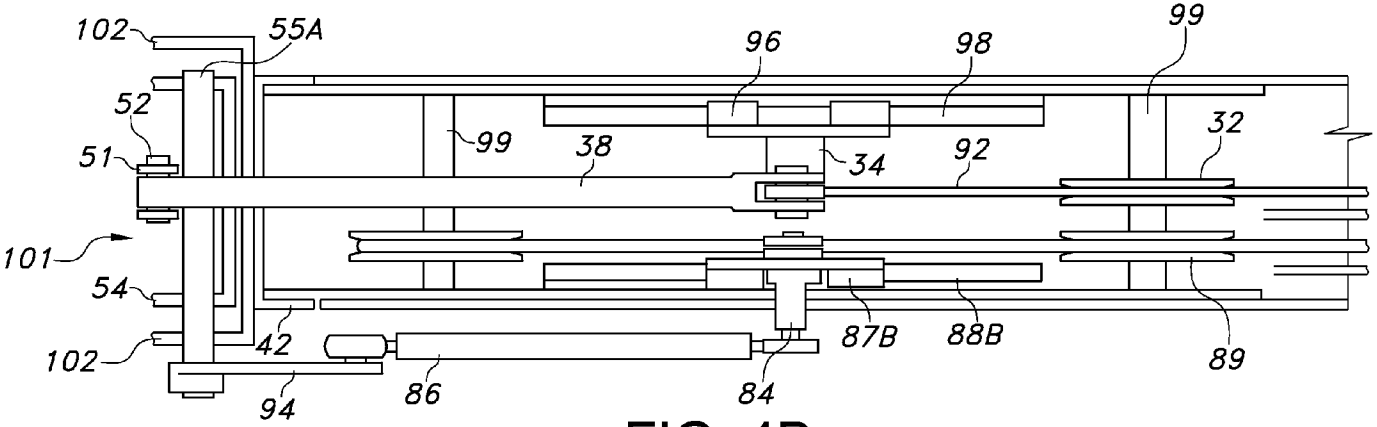
FIG. 4B is a top plan view of the drive unit.
Figure 4C:
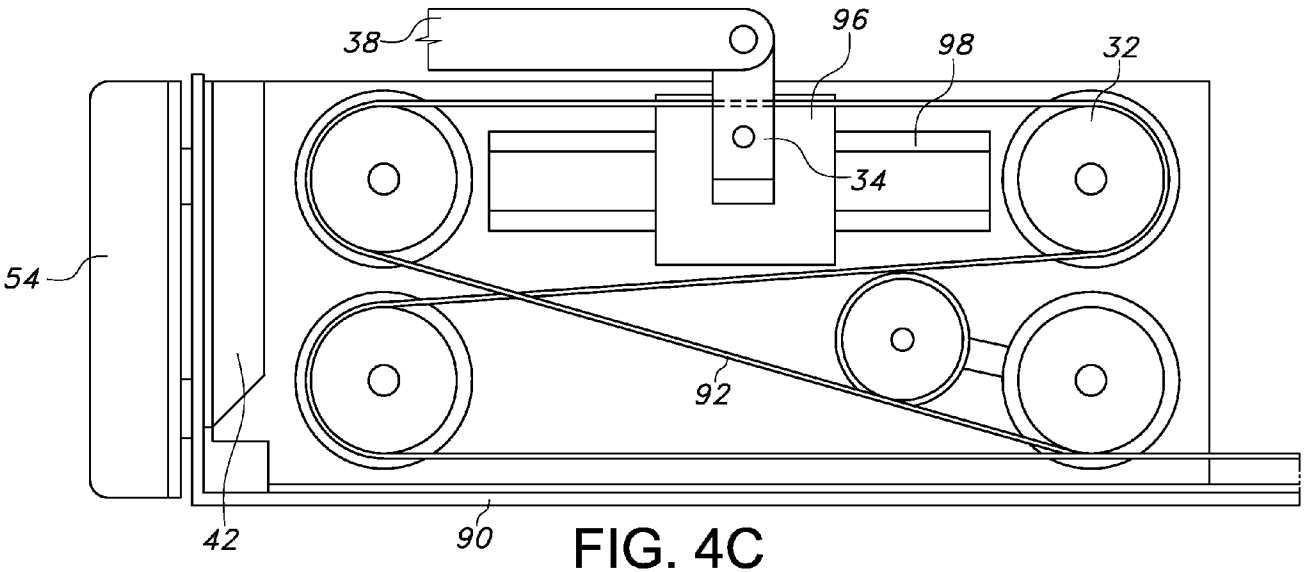
FIG. 4C is a side elevation view of the drive unit.

FIGS. 4A-4C illustrate the drive unit 30 with its corresponding rear drive guide rail 98 and rear carriage assembly 96. The drive cable 92 is routed through a plurality of drive unit pulleys 32 and then clamped to the rear drive carriage assembly 96 by means of the clamp 93. The carriage assembly 96 is connected to a drive link 38 by means of a drive link bracket 34. The drive link 38 extends rearward out through a notch in the stern wall 102 and is coupled to the fluke assembly 50. The drive cable 92 is pulled back and forth a total travel distance of about six inches by reciprocating action on the pedals 12, which forces the carriage assembly 96 to travel back and forth along the rear drive guide rail 98, thereby moving the drive link 38 forward and aft.

Figure 5A:
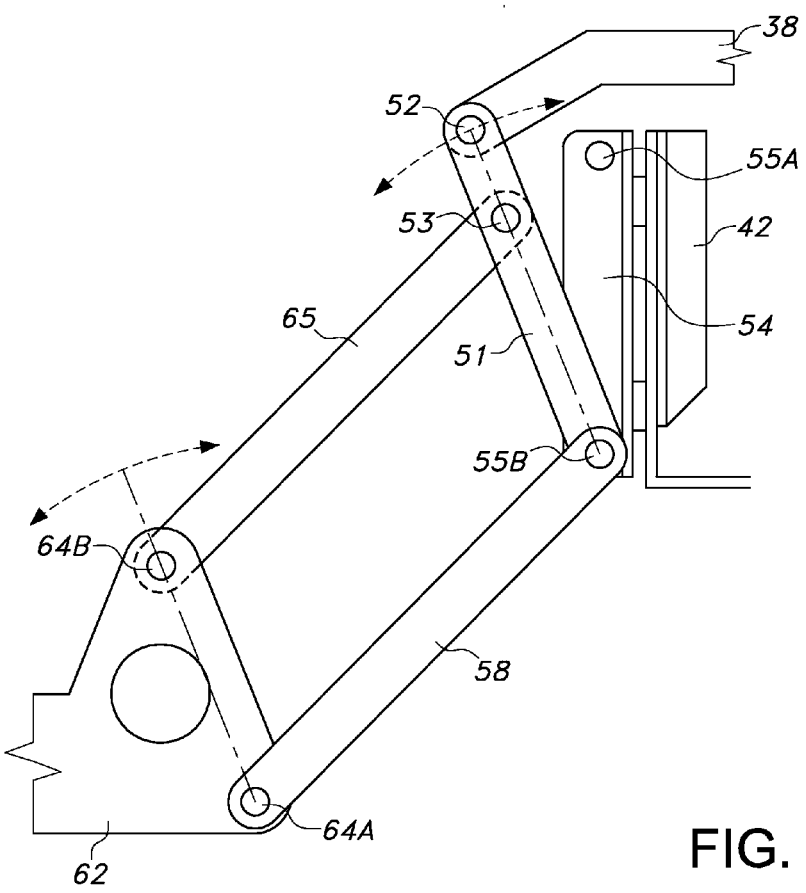
FIG. 5A is a side plan view of the fluke drive.
Figure 5B:
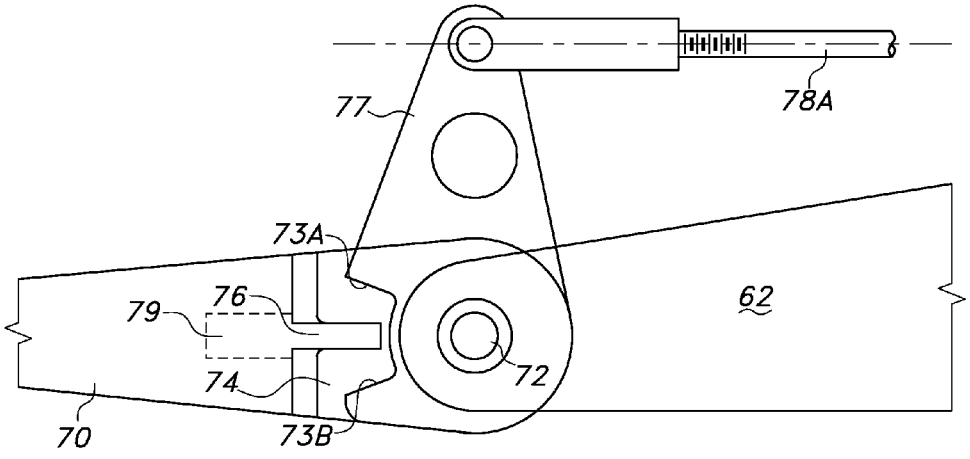
FIG. 5B is a side plan view of the fluke, socket, and fluke plate.
Figure 5C:
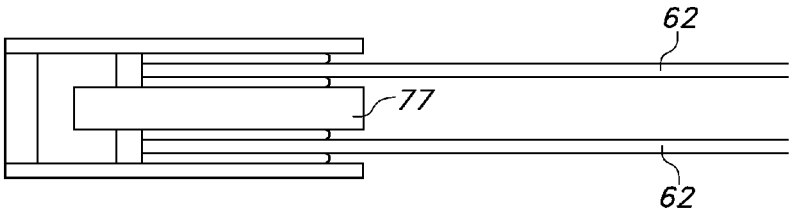
FIG. 5C is a top plan view of the elements shown in FIG. 5B.

FIGS. 5A, 5B, and 5C illustrate in detail the linkages in the fluke assembly 50 that drive the motion of the fluke 70. It is generally understood, that a fluke or foil loses its effective lift when the angle of attack exceeds a certain angle and this is taken into consideration in the design of the fluke assembly 50. In the embodiment shown, the angle of attack is approximately plus/minus 20 degrees on the upstroke and downstroke. The fluke 70 moves vertically a certain distance at a defined and constant angle relative to a horizontal plane and, when reversing direction of travel, the fluke 70 flips, due to the force of the water, changing its angle of attack to the other side of the horizontal plane. In other words, on the upstroke, the force of the water forces the fluke 70 to a downward angle, and on the downstroke, forces the fluke to an upward angle. This motion approximates the natural fluke action of a whale or dolphin, which is known to be a very effective way to propel a mass through water.

Four-bar linkages are used on the fluke assembly 50 to move the fluke 70 in the desired manner. The fluke assembly 50 extends outward from the stern end of the kayak K and is centered about the centerline CL of the kayak. The support for the fluke assembly 50 is a vertical support bracket 42 that is mounted on the inside of the vertical wall 102 in the opening 101, shown in FIG. 3D. A stern bracket 54 is attached to the support bracket 42 through the vertical wall 102. The stern bracket 54 is a C-channel, the intermediate section of the channel being affixed to the support bracket 42 and the two side sections having bores to support upper horizontal shaft 55A and lower horizontal shaft 55B. Horizontal shaft 55A extends through vertical side walls of the opening 101 into the hull of the kayak. The link 38 is movably coupled to the upper ends of two vertical drive arms 51 at a hinge point 52 and the lower ends of the vertical drive arms and the main elevator arms 58 are coupled to the lower horizontal shaft 55B. A horizontal drive arm 65 is coupled to a midpoint coupling point 53 on each respective vertical drive arm 51 at one end and to a top pivot point 64B on a fluke lift plate 62. The lower end of the main elevator arms 58 are coupled to a horizontal shaft at a lower pivot point 64A on the fluke lift plate 62.

The fluke 70 has a foil-shaped cross-section, as shown in FIG. 1. In plan view, the particular shape may vary, although triangular shapes are most similar to the shapes of flukes found on whales and dolphins. The fluke 70 is connected to the fluke assembly linkage 50 so as to be removable for transportation and storage.

FIGS. 5B and 5C illustrate the linkages that control the angle of attack of the fluke 70. Only a partial view of the fluke lift plate 62 is shown here, the portion that has a third coupling point that is coupled via a fluke pivot shaft 72 to the fluke 70 and also to a fluke stop link 77, which has upper and lower stop edges 73A and 73B. A mounting socket 74 with a stop blade 76 connects the fluke 70 with the fluke lift plate 62 and the fluke stop link 77. The fluke stop link 77 and the blade 76 cooperate to limit the rotation of the fluke 70 to the optimum force transmission arc about the fluke pivot 72. Thus, when the stop blade 76 contacts the stop edges 73A and 73B, the fluke 70 is prevented from swinging further upward or downward.

Figure 5D:
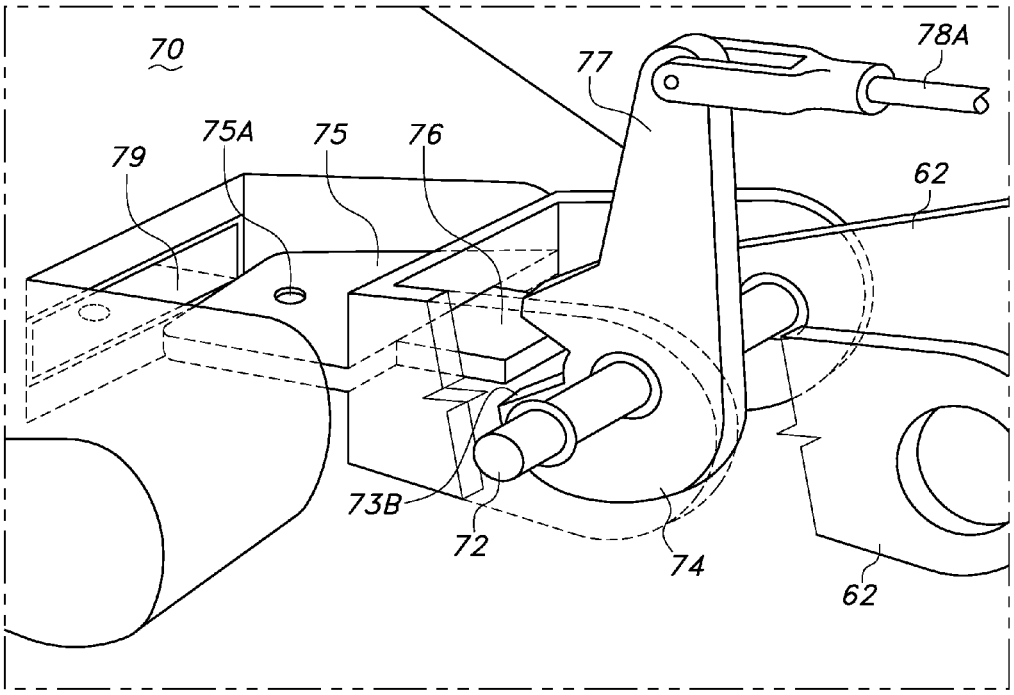
FIG. 5D is a perspective view of the socket connector.

FIG. 5D illustrates details of the mounting socket 74 and the fluke 70. The leading edge of the fluke 70 has a connector 79 for receiving a mounting socket 74 that is also coupled to the fluke pivot shaft 72. The mounting socket 74 is aligned with the centerline CL of the kayak, between the trailing ends of the two fluke lift plates 62 and, in addition to the stop blade 76, also has a socket assembly 75 that is insertable into the connector 79, which, in the embodiment shown, is a rectangular tubular socket that is dimensioned to receive the socket assembly 75. The mounting socket 74 aligns with the shape of the foil to provide a smooth transition of fluke to socket, so as to reduce drag on the movement of the fluke and socket through the water. A threaded bore 75A is shown in the socket assembly 75. A corresponding bore may be provided in one or both surfaces of the fluke 70, so that a quick-coupling fastener, for example, may be used to fasten the fluke 70 and mounting socket 74 together, in a manner that allows the fastener to be quickly and easily fastened or released.

Figure 6A:
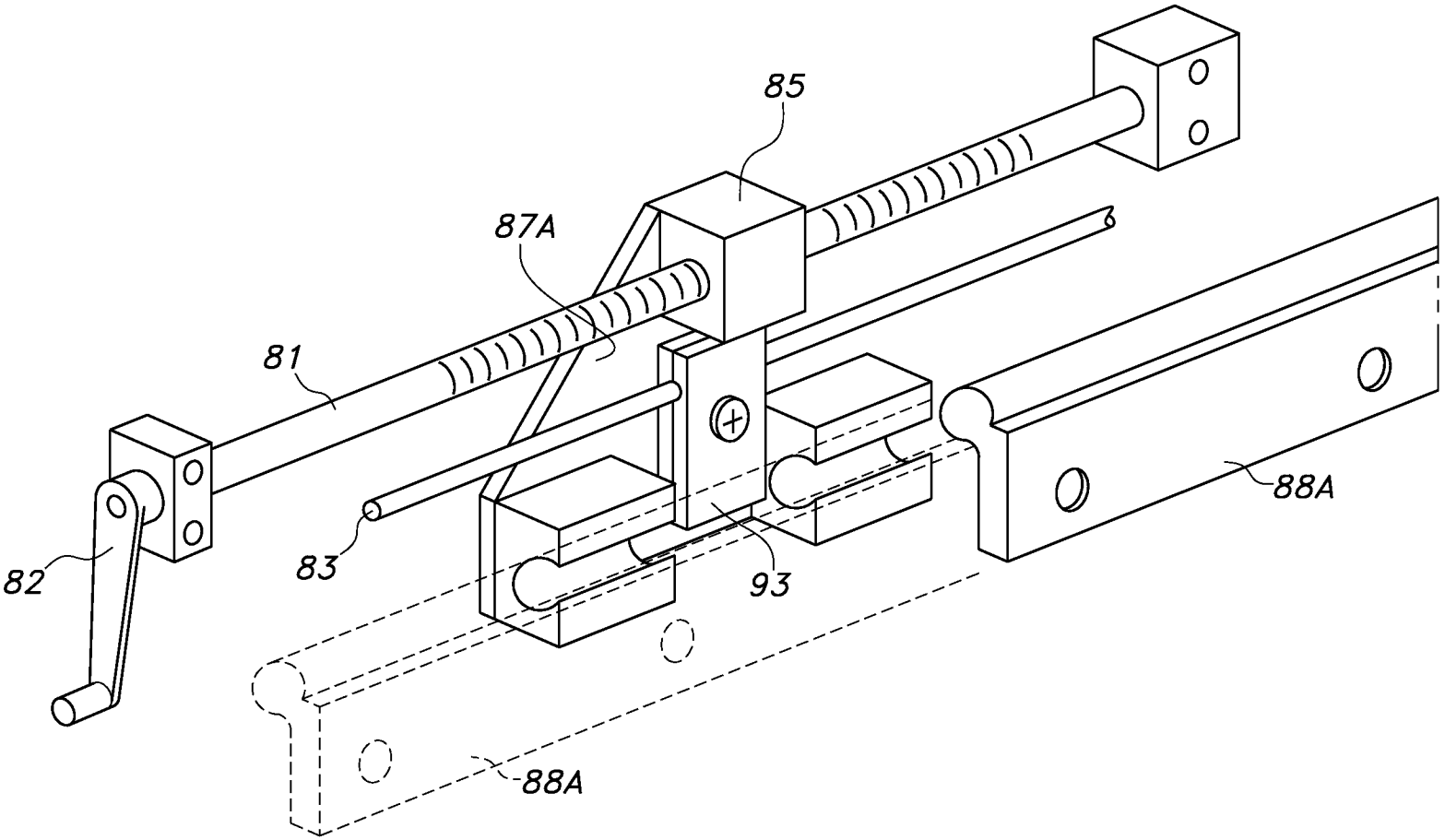
FIG. 6A is a perspective view of a guide rail and carriage assembly for the lift cable.
Figure 6B:
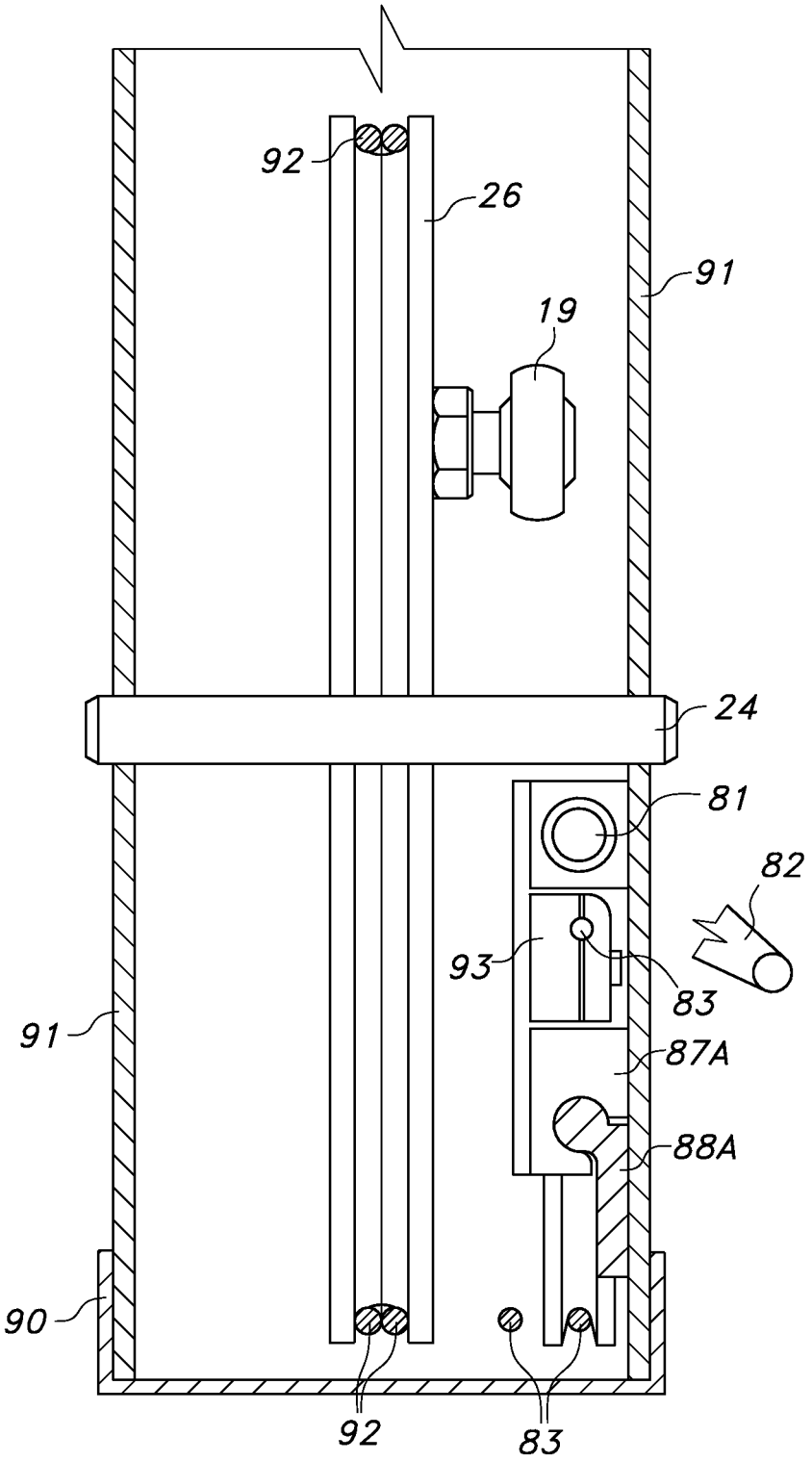
FIG. 6B is cross-sectional view of the drum pulley and the guide rail and carriage assembly for the lift cable.
Figure 6C:
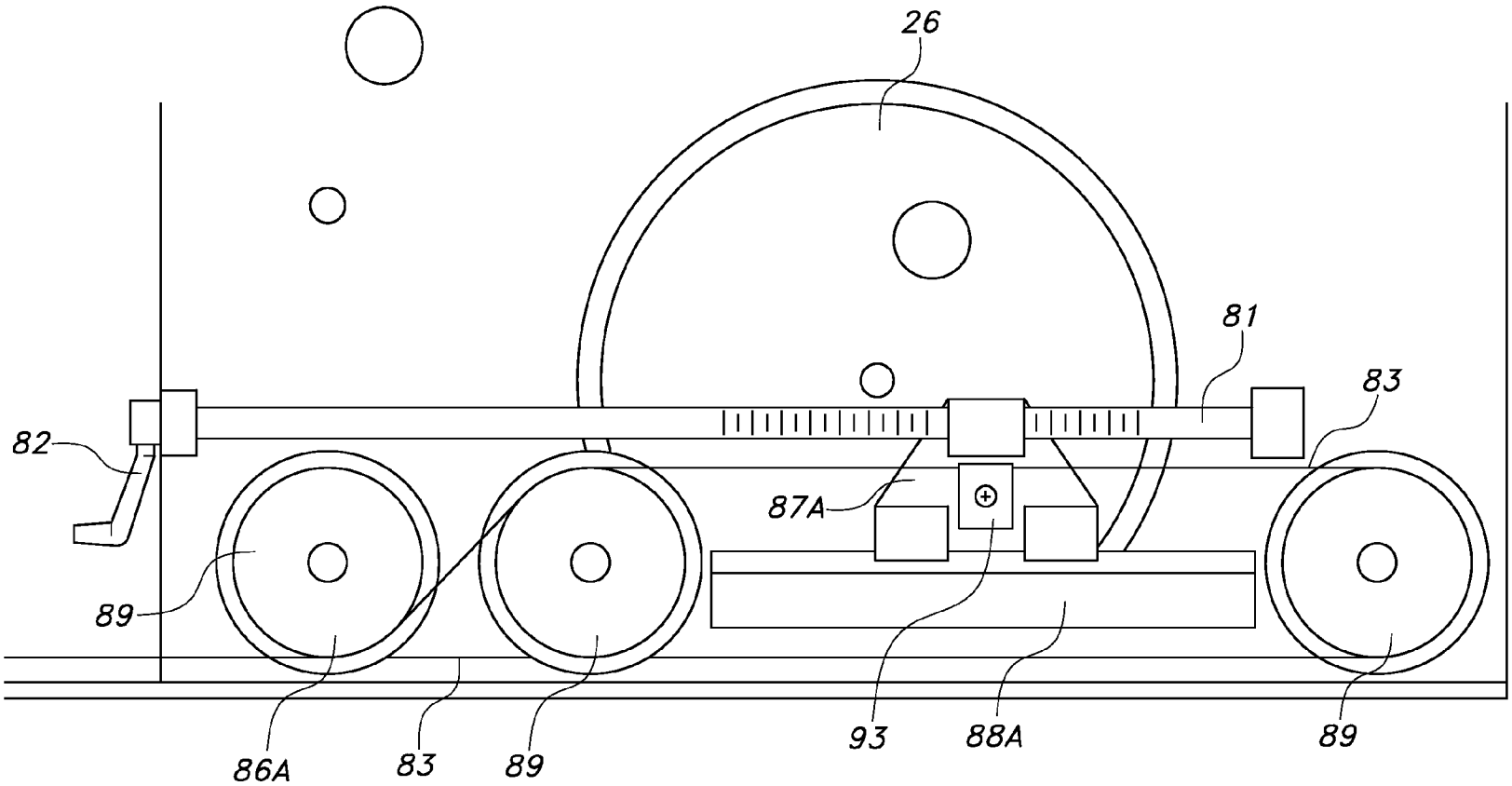
FIG. 6C is a side elevation view of the drum pulley, guide rail, and carriage assembly for the lift cable.
Figure 6D:
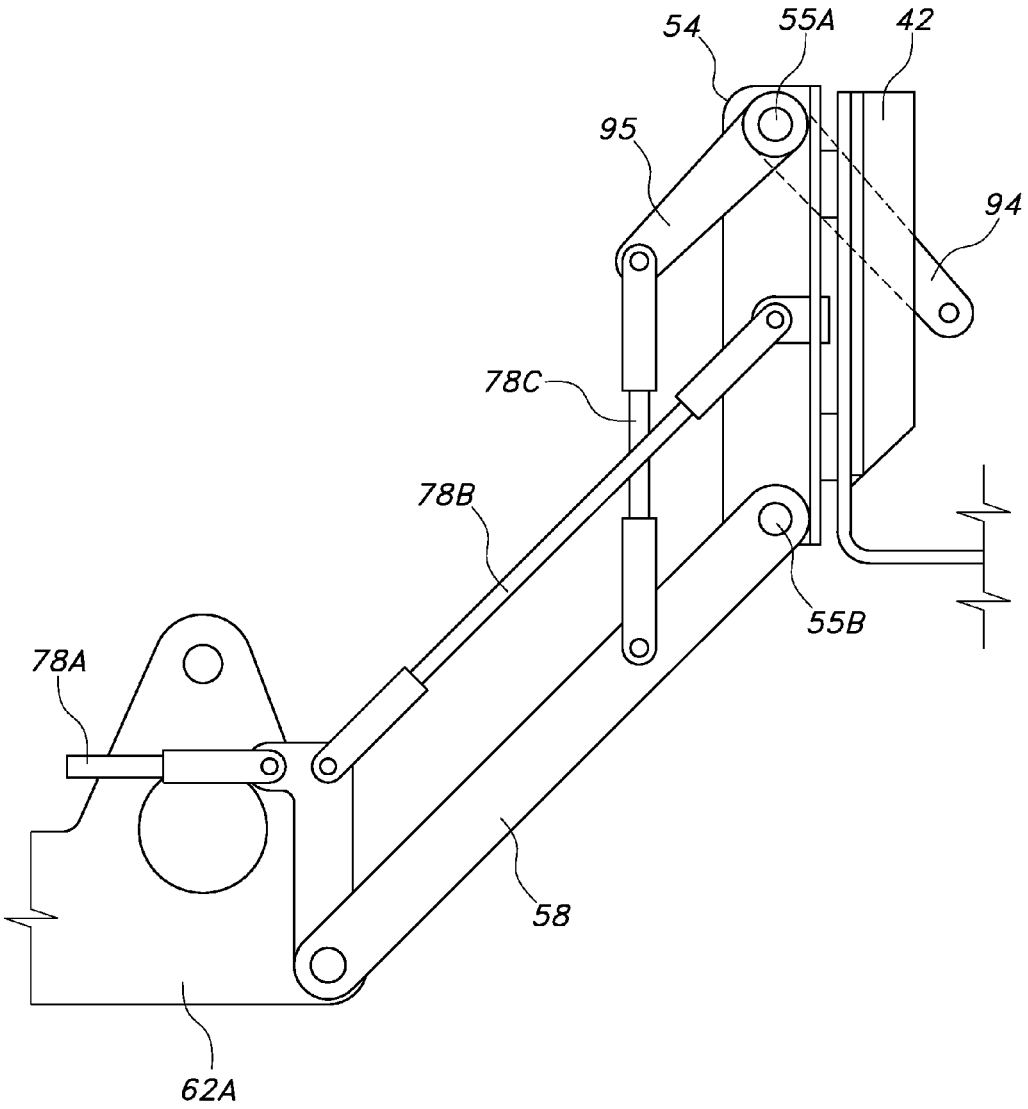
FIG. 6D is a side plan view of the lift and stop connections.
Figure 6E:
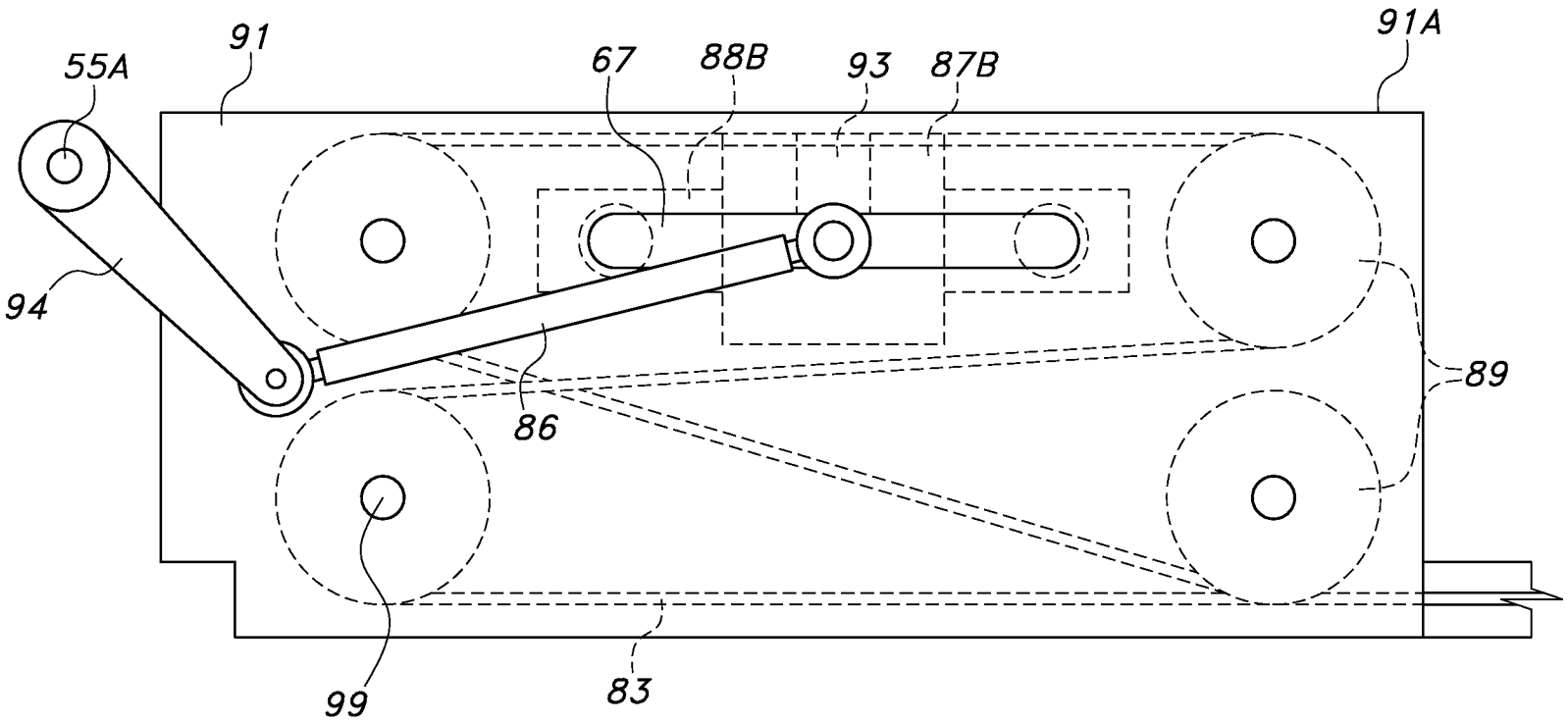
FIG. 6E is a side elevation view of the lift mechanism in the drive unit.

FIGS. 6A-6E illustrate the lift mechanism 80 that raises the fluke assembly 50 above the bottom level of the kayak, so that the kayak K may be launched, beached, or transported. FIG. 6E illustrates a lift cable 83 guided through the drive unit section 30 in a configuration that corresponds closely to how the drive cable 92 is guided through the drive unit, i.e., the cable 83 is guided over a plurality of lift cable pulleys 89 and then held in a cable clamp 93 that is mounted on a rear lift cable carriage assembly 87B, which in turn is slidably mounted on a rear lift cable guide rail 88B. The lift mechanism elements are shown in dashed lines, because, when looking at FIG. 4C, these elements are hidden by the drive unit elements A crank 82, shown in FIG. 1, is positioned on the inside end of pedal assembly 10, outside the box that encloses the drive elements, and is accessible to the paddler. Rotating the crank 82 turns a threaded rod 81 that passes through a threaded bore 85 that is fixedly mounted on the front lift cable carriage assembly 87A. Turning the rod 81 forces the carriage assembly 87A to travel along a front lift cable guide rail 88A, either toward the bow or the stern, depending on the direction of rotation. The lift cable 83 is clamped to the front lift cable carriage assembly 87A by a cable clamp 93, so that the travel of the front lift cable carriage assembly 87A also pulls the lift cable 83 in the corresponding directions.

FIGS. 4A, 4B, and 4C also illustrate a portion of the lift mechanism 80 in the drive unit section of the cable tray 90. The lift cable 83 extends along the cable tray 90 and into the drive unit 30 where it is then routed through a series of lift cable pulleys 89, which are mounted on shafts 99 that extend transverse to the centerline CL between two vertical walls 91, and which serve to align the lift cable 83. The lift cable is affixed to a rear lift carriage assembly 87B by a cable clamp 93. Referring now to FIGS. 4B and 6E, a lift post 84 is affixed to and extends outward from the rear lift carriage assembly 87B through a slot 67 in a vertical wall 91 and is coupled to an extender arm 86 on its outer end. The extender arm 86 is coupled to a lift link 94 which is coupled to the horizontal shaft 55A inside of the hull. As the lift cable 83 is pulled back or forward the horizontal shaft 55A rotates.

Lift arms 95, shown in FIG. 6D, are also rigidly mounted to the horizontal shaft 55A, and are connected to main elevation arms 58 by a lift link 78C. As the horizontal shaft 55A rotates, the lift arms 95 pivot up or down, depending on the rotation of the shaft, forcing the lift link 78C to raise or lower the main elevation arms 58 and the fluke plates 62, thereby raising or lowering the entire fluke assembly 50 in a vertical plane.

A link assembly identified in the figures as 78A and 78B ensures that the limit in the rotation of the fluke 70 is constant through the full range of fluke plate 62 motion. When the kayak k is first launched, the lift mechanism 80 should be in the highest position thereby keeping the fluke assembly 50 elevated above the bottom on the kayak K. Once in the water, the paddler pushes or paddles to a place in the body of water with sufficient depth to lower and operate the fluke assembly 50. Once that location has been reached, the paddler turns the crank 82, thereby lowering the fluke assembly 50 into its operable lower position. As the paddler works the pedals 12, the force transmitted through the drive unit 30 to the fluke unit 50 causes the fluke 70 to swing alternatingly upward and downward about the fluke pivot 72, which movement propels the kayak K across the surface of the water.

The drive mechanisms for the various assemblies have been described as linkages with cables, pulleys, etc. It is understood, that a pedal unit that actuates hydraulic elements may be used to effect the undulating up and down motion of the fluke 70.

It is understood that the embodiments described herein are merely illustrative of the present invention. Variations in the construction of the linear propulsion system for small watercraft may be contemplated by one skilled in the art without limiting the intended scope of the invention herein disclosed and as defined by the following claims.

What is claimed is:

1. A small watercraft propulsion system comprising:

a pedal assembly that is operatable by a user;

a drive unit that is powered by the pedal assembly;

a fluke activation mechanism that is actuated by the drive unit;

a fluke that is pivotably attached to the fluke activation mechanism;

wherein operating the pedal assembly transmits a force through the drive unit to the fluke activation mechanism that causes the fluke to move in an up and down manner; and wherein the fluke moves vertically a certain distance at a defined and constant angle relative to a horizontal plane and then flips when reversing direction to move in a defined and constant angle on the opposite side of the horizontal plane, thereby propelling the watercraft along the surface of the water.

2. The propulsion system of claim 1, wherein a lift mechanism is included to elevate and lower the fluke activation mechanism and the fluke.

3. The propulsion system of claim 1, wherein the drive unit includes a drive cable that is wrapped around a drum pulley and is coupled to a drive link and the drive link is coupled to the fluke activation mechanism, and wherein the pedal assembly includes a pedal force transmission means that exerts a pull on the drum pulley that causes the drum pulley to oscillate back and forth, thereby transmitting a force from the pedal assembly to the fluke activation mechanism.

4. The propulsion system of claim 3, wherein the drive unit includes a plurality of drive unit pulleys, a rear guide rail, and a rear drive carriage assembly that is slidably mounted on the rear guide rail, and wherein the drive cable is routed through the drive unit pulleys and clamped to the rear drive carriage assembly.

5. The propulsion system of claim 3, wherein the fluke activation mechanism includes vertical drive arms, main elevator arms, and fluke lift plates, and wherein the drive link is movably coupled to the upper ends of the vertical drive arms at a hinge point and the lower ends of the vertical drive arms and the upper ends of the main elevator arms are coupled to a lower horizontal shaft and wherein the lower ends of the main elevator arms are coupled to a pivot point on the fluke lift plate.

6. The propulsion system of claim 5, wherein the fluke activation mechanism includes a fluke stop link, wherein a mounting socket with a stop blade connects the fluke with the lift plate, and wherein the fluke stop link and the blade cooperate to limit the rotation of the fluke.

7. The propulsion system of claim 2, wherein the lift mechanism includes a lift cable that is routed through a series of lift cable pulleys that are mounted in the drive unit and is affixed to a rear lift carriage assembly, wherein a lift post is affixed to and extends outward from the rear lift carriage assembly where it is coupled to an extender arm that is coupled to one end of an extender arm that is coupled on the other end to a horizontal shaft, wherein the upper ends of lift arms are mounted to the same shaft as the extender arm and are connected to the main elevation arms by a lift link, and wherein exerting a force on the lift cable causes the cable to move forward or aft through the lift cable pulleys and push or pull the extender arm, thereby causing the lift arms to raise or lower the fluke activation mechanism.

8. The propulsion system of claim 1, wherein the pedal assembly includes a pair of pedal units that drives the pedal force transmission means which includes a chain and sprocket assembly, and wherein applying force to the pedal units drives the chain and sprocket assembly that is used to exert a pull on the drum pulley so that the pulley oscillates back and forth, thereby exerting a force on the drive cable.

9. The propulsion system of claim 8, wherein the chain and sprocket assembly includes two pedal sprockets attached to the pedal units, two pulley sprockets attached to either side of the drum pulley, and a two-chain set that converts the action of the two pedals to an oscillating pull on the drum pulley, wherein the first chain runs in a continuous loop from the top of the first pedal sprocket to the top of the first pulley sprocket, around the bottom of the pulley sprocket to the bottom of the pedal sprocket, and wherein the second chain loops in a crossed manner from the top of the second pedal sprocket to the bottom of the second pulley sprocket, around the top of the second pulley sprocket and through a modified link in the second chain to the bottom of the pedal sprocket.

* * * * *